US005628562A

United States Patent [19]

Krumm

[11] Patent Number: 5,628,562

[45] Date of Patent: May 13, 1997

[54] MULTI-COMPONENT MIXER WITH EXCHANGEABLE CARTRIDGE

[75] Inventor: Christian Krumm, Bienne, Switzerland

[73] Assignee: Octal Technologies Ch. Krumm, Bienne, Switzerland

[21] Appl. No.: 608,312

[22] Filed: Feb. 28, 1996

[30] Foreign Application Priority Data

Mar. 22, 1995 [EP] European Pat. Off. ..... 95810195

[51] Int. Cl.[6] ..... B01F 11/00

[52] U.S. Cl. ..... 366/240; 366/336

[58] Field of Search ..... 366/348, 349, 366/69, 108, 117, 118, 9, 219, 240, 336, 338, 340, 339

[56] References Cited

U.S. PATENT DOCUMENTS

| | | | |
|---|---|---|---|
| 2,960,317 | 11/1960 | Bopine | 366/117 |
| 3,439,899 | 4/1969 | Hershler | 366/348 |
| 3,460,809 | 8/1969 | Hauss | 366/348 |
| 3,588,054 | 6/1971 | Herman | 366/69 |
| 4,252,497 | 2/1981 | Borodin | 366/349 |

FOREIGN PATENT DOCUMENTS

| | | |
|---|---|---|
| 3838530A1 | 5/1990 | Germany . |
| 9319325 | 4/1994 | Germany . |
| 674717A5 | 7/1990 | Switzerland . |
| 2086248 | 4/1982 | United Kingdom . |

*Primary Examiner*—Robert W. Jenkins
*Attorney, Agent, or Firm*—Oliff and Berridge

[57] ABSTRACT

The multi-component mixer is characterized by great simplicity of manufacture, use and mounting in the installation. A semi-rigid tube is fitted onto two joining pieces held by two collars. Components of the product to be mixed enter the tube at one end, and after stirring takes place, the product, ready to use, is discharged at the other end.

9 Claims, 1 Drawing Sheet

MULTI-COMPONENT MIXER WITH EXCHANGEABLE CARTRIDGE

BACKGROUND OF THE INVENTION

This invention relates to a multi-component mixer which is very easy to use owing to a simple, easily detachable and dispensable mixing cartridge.

Products having several components which change state as a result of a chemical process after they have been mixed are being used more and more in industry. In practice, it is necessary to have complex dosing and mixing equipment which is difficult to maintain and to clean, even using dangerous solvents, without loss of time in the course of product manufacture.

SUMMARY OF THE INVENTION

The present invention relates to a method of mixing several components by means of a contrivance having interchangeable elements of low cost which can be thrown away so that cleaning is avoided.

DETAILED DESCRIPTION OF PREFERRED EMBODIMENTS

Figure 1:
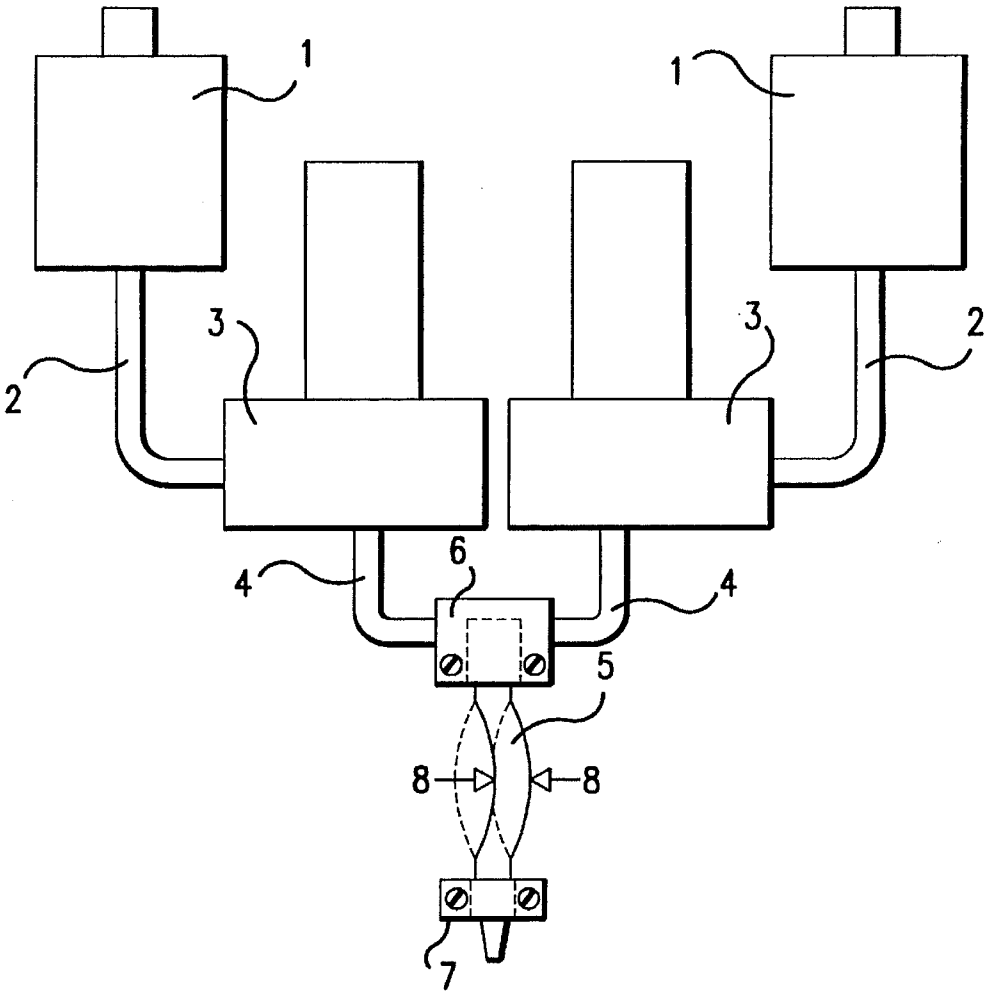
FIG. 1 is a diagram of a whole dosage installation.

The invention will be better understood from the description of the embodiment according to FIG. 1, showing an example of a general installation comprising several parts mounted in a frame or any other support (not shown). The different components are placed in the reservoirs 1 connected by the pipes 2 to dosing units 3, discharging the different components of the product through the outlet orifices 4 to the mixer tube 5. The tube 5 is fixed to the whole by the head 6 and the collar 7.

A circular motion, or a motion from left to right, or vice-versa, or any other motion, is imparted to the mixer tube 5 by mechanical means 8. The type of mechanical means is of no particular importance, and is thus not shown here. These means produce the displacements, preferably in the middle of said tube 5, without turning it.

Figure 2:
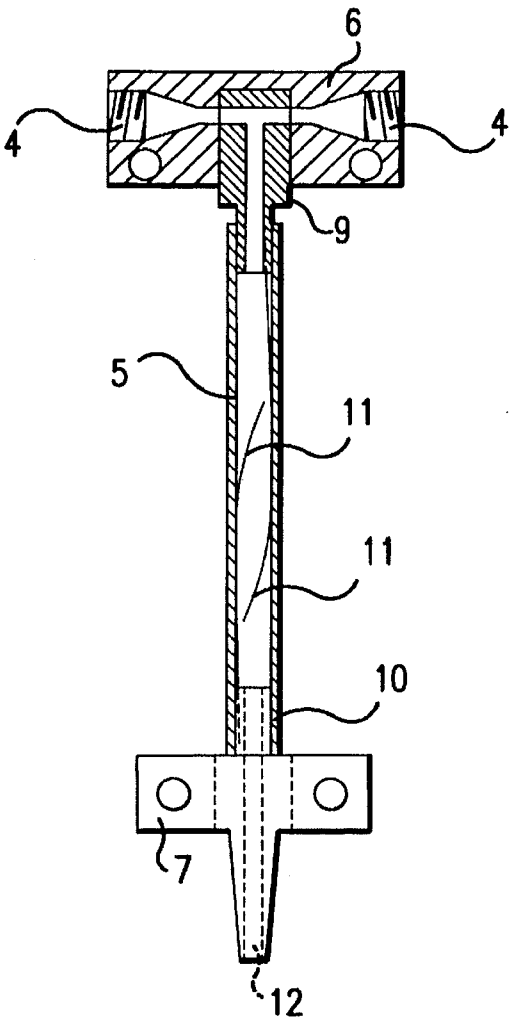
FIG. 2 is an example of a mixer having a cartridge which is quickly interchangeable.

FIG. 2 relates to the mixer tube 5 comprising said tube, which is flexible or semi-rigid, made of a material with little or no sensitivity to the product. Tube 5 is fitted onto the joining pieces 9 and 10 to which metal wires 11 can be fixed with the aim of perfecting the mixing, inside the mixer tube 5, of components introduced through the orifice 4 and passing through the tube to come out again through the orifice 12.

This arrangement of tube 5, with the joining pieces 9 and 10, forms the part which is detachable from the head 6 and the collar 7, and quickly replaceable as an exchangeable cartridge. After use, it is either thrown away as a unit or is partly recovered following cleaning. The length and the diameter of different tubes 5 can vary, depending upon product viscosity and dosed quantities.

What is claimed is:

1. A mixer, the active part of which comprises a flexible or semi-rigid tube fixed at both ends and agitated in a middle portion between the ends by mechanical movement from an external mechanical device to mix components through transverse displacement of the tube at the middle portion.

2. The mixer of claim 1 in which the ends of the tube are fitted onto two joining pieces to which one or more wires, can be fixed, which penetrate into the tube and participate in stirring the components.

3. The mixer of claim 2 in which the joining pieces are held firmly by collars and in which the entry of components takes place at one of the ends of the tube and the exit of mixed components takes place at the other end.

4. Mixer according to claim 3 in which the tube can be easily detached from the collars in order to be exchanged, then either cleaned or thrown away.

5. The mixer according to claim 2, wherein the wires are metal.

6. The mixer according to claim 2, wherein the wires are plastic.

7. The mixer according to claim 1, wherein the ends of the tube are fitted inside two joining pieces to which one or more wires can be fixed, the wires penetrating into the tube and participating in stirring the components.

8. The mixer according to claim 7, wherein the wires are metal.

9. The mixer according to claim 7, wherein the wires are plastic.

* * * * *